United States Patent [19]

Feliciano et al.

[11] Patent Number: 4,754,194

[45] Date of Patent: Jun. 28, 1988

[54] FLOURESCENT LIGHT BULB

[76] Inventors: Wilson Feliciano; Guillermo Mendez, both of 415 Stratford Rd., Apt. 2M, Brooklyn, N.Y. 11218; George Spector, 233 Broadway, Rm. 3815, New York, N.Y. 10007

[21] Appl. No.: 912,221

[22] Filed: Sep. 26, 1986

[51] Int. Cl.[4] ..... H05B 31/06; H05B 31/50; H05B 31/04

[52] U.S. Cl. ..... 313/491; 313/493; 313/632; 313/621; 313/581; 313/307

[58] Field of Search ..... 313/491, 492, 493, 631, 313/632, 637, 621, 581, 567, 574, 576, 596, 643, 484, 485, 618, 619, 634, 302

[56] References Cited

U.S. PATENT DOCUMENTS

| | | | |
|---|---|---|---|
| 1,894,462 | 1/1933 | Davis | 313/643 |
| 1,948,720 | 2/1934 | Knowles | 313/643 |
| 4,093,893 | 6/1978 | Anderson | 313/492 X |
| 4,298,822 | 11/1981 | Fukuda | 313/634 X |
| 4,315,187 | 2/1982 | Chow | 313/631 X |
| 4,408,141 | 10/1983 | Byszewski et al. | 313/306 X |
| 4,516,057 | 5/1985 | Proud et al. | 313/306 X |

*Primary Examiner*—David K. Moore
*Assistant Examiner*—Michael Horabik

[57] ABSTRACT

A self starter neon lamp is provided and contains a screw-in base to fit conventional screw sockets, substitutes neon gas for mercury and argon gas and utilizes flat metal ring-shaped cathodes within. In a modification the lamp is in a U-shaped configuration and utilizes two sets of curved flat metal ring-shaped cathodes within to enhance arc discharge therethrough.

2 Claims, 1 Drawing Sheet

FLOURESCENT LIGHT BULB

BACKGROUND OF THE INVENTION

The instant invention relates generally to fluorescent lamps and more specifically it relates to a self starter neon lamp.

Numerous fluorescent lamps have been provided in prior art that are adapted to produce fluorescent light and contain screw-in plugs as replacements for standard incandescent lamps. For example, U.S. Pat. Nos. 4,311,942; 4,311,943 and 4,536,675 are all illustrative of such prior art. While these units may be suitable for the particular purpose to which they address, they would not be as suitable for the purposes of the present invention as heretofore described.

SUMMARY OF THE INVENTION

A primary object of the present invention is to provide a self starter neon lamp that will provide improved lumination.

Another object is to provide a self starter neon lamp that contains a screw in base to fit conventional screw sockets, substitutes neon gas for mercury gas and utilizes flat metal ring-shaped electrodes within.

An additional object is to provide a self starter neon lamp that is in a U-shaped configuration and utilizes two sets of curved flat metal ring-shaped cathodes within to enhance arc discharge therethrough.

A further object is to provide a self starter neon lamp that is simple and easy to use.

A still further object is to provide a self starter neon lamp that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
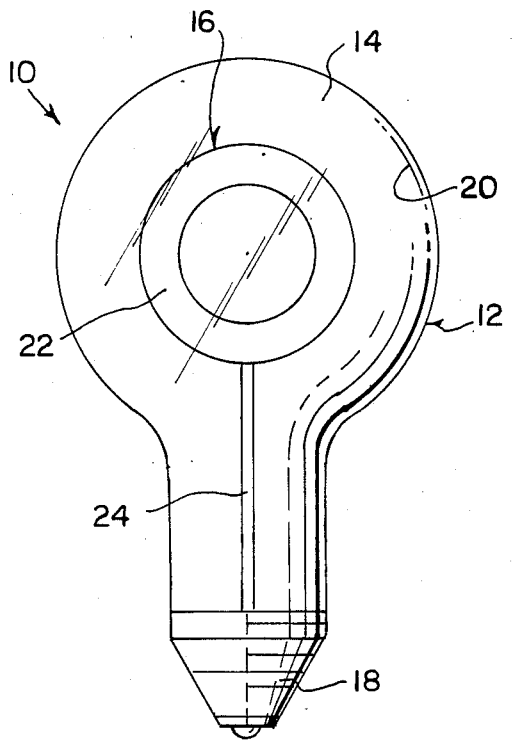
FIG. 1 is a front view of the invention.
Figure 2:
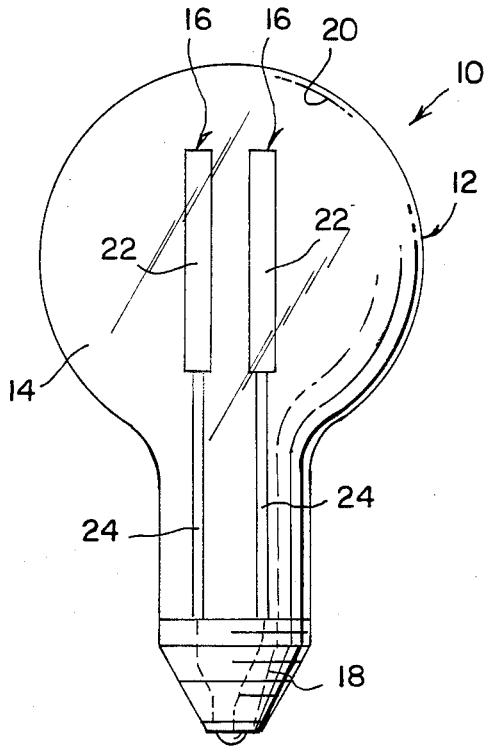
FIG. 2 is a side view thereof.

Turning now descriptively to the drawings, in which similar reference characters denote similar elements throughout the several views, FIGS. 1 and 2 illustrates a self starter neon lamp 10 consisting of an outer transparent envelope 12 which is closed in a vacuum-tight manner. Neon gas 14 is filled within the envelope 12. A pair of electrodes 16 are placed within the envelope 12 to form an arc discharge. A screw-in base 18 is secured to the envelope 12 and electrically operatively connected to the electrodes 16. A luminescent phosphor coating 20 is provided on interior wall surface of the envelope 12 which converts ultraviolet radiation generated in the envelope 12 into visible light.

Each of the electrodes 16 comprises a flat metal ring-shaped cold electrode member 22 and an elongated metal rod 24 extending from the base 18 within the envelope 12 to support the electrode member 22.

Figure 3:
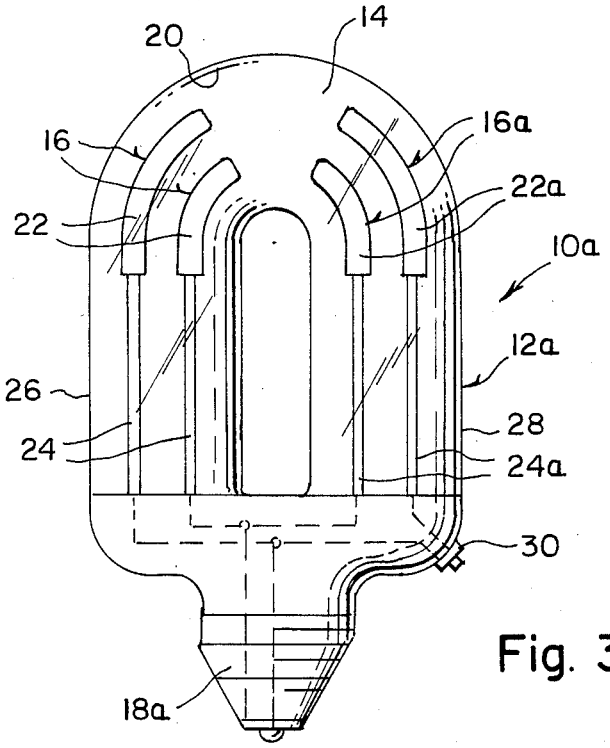
FIG. 3 is a side view of a modification having two electrodes on each side of a U-tube configuration, including a switch for controlling one of said electrodes.

FIG. 3 shows a modified self starter neon lamp 10*a* wherein the transparent envelope 12*a* is U-shaped having two spaced legs 26, 28 secured to the base 18*a*. A first pair of electrodes 16 (cathode and anode) are placed within leg 26 while second pair of electrodes 16*a* (cathode and anode) are placed within other leg 28 thereby providing dual sources of illumination symmetrically disposed. Each pairs of ring shaped electrodes curved and parallel to the contour of the U-shaped envelop 12*a*. A switch 30 is included to control actuation of one electrode 16*a* to provide a dimmer or brighter light by controlling actuation of electrodes 16*a*. The provision of a curved parallel cathode anode electrode pair in each leg of the lamp provides a greater intensity of illumination for the ratio of length of tube to the overall diameter and further provides for illumination in the event one pair of electrodes fails.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A self starter neon lamp having a longitudinal axis comprising:

(a) an outer transparent envelope which is closed in a vacuum tight manner;

(b) neon gas filled within said envelope;

(c) a pair of electrodes within said envelope to form an arc discharge;

(d) a screw-in base secured to said envelope and electrically operatively connected to said electrodes;

(e) a luminescent phosphor coating on interior wall surface of said envelope which converts ultra violet radiation generated in said envelope into visible light, wherein said electrodes comprise:

(f) spaced flat ring-shaped cathode and anode members parallel to said longitudinal axis; and (g) conductor support rods extending from said base within said envelope to support each said electrode wherein said rods are parallel to said longitudinal axis, further comprising said transparent envelope being U-shaped having two spaced legs secured to said base, further comprising a second pair of similar electrodes whereby said first pair of electrodes are placed within one leg and the second pair of electrodes are placed within the other leg of said envelope to provide illumination in each leg; wherein each of said electrodes is curved and parallel to the contour of said U-shaped envelope.

2. A lamp as in claim 1 with switch and circuit means whereby each pair of electrodes is in parallel with the power source and whereby one of said pairs of electrodes may be deactuated.

* * * * *